US005188227A

United States Patent [19]

Ho

[11] Patent Number: 5,188,227

[45] Date of Patent: Feb. 23, 1993

[54] STATIONERY BOX IN THE SHAPE OF A VIDEO CAMERA

[76] Inventor: Teng L. Ho, P.O. Box 372, Hsin Chu, Taiwan

[21] Appl. No.: 786,938

[22] Filed: Nov. 4, 1991

[51] Int. Cl.[5] ..... A45C 11/34

[52] U.S. Cl. ..... 206/214; 206/457

[58] Field of Search ..... 206/214, 457

[56] References Cited

U.S. PATENT DOCUMENTS 5,069,361 12/1991 Jeffway, Jr. et al. ..... 206/214 X 5,074,417 12/1991 Kenny ..... 206/457 X

FOREIGN PATENT DOCUMENTS 521002 3/1931 Fed. Rep. of Germany ..... 206/214

1510 of 1868 United Kingdom ..... 206/214

*Primary Examiner*—William I. Price

[57] ABSTRACT

A stationery box made in the shape of a video camera, comprising a hinged top cover which has partition strips for holding elongated writing or drawing materials, a hinged side cover which has a plate for holding paints, an inner box at the inside which has a drawer for keeping writing materials and a rotary crayon holder for keeping crayons, a pen holder at the inside which has slots and vertical grooves for inserting elongated writing materials, and a sliding seat moved to carry crayons away from said rotary crayon holder.

6 Claims, 3 Drawing Sheets

STATIONERY BOX IN THE SHAPE OF A VIDEO CAMERA

BACKGROUND OF THE INVENTION

The present invention relates to a stationery box and relates more particularly to such a stationery box made in the shape of a V8 video camera which has a variety of compartments for keeping different writing materials.

Several material may be respectively used during drawing. Therefore, several drawing materials shall be prepared before drawing. For keeping different drawing materials in order, different stationery boxes may be required. The present invention has been accomplished to provide a diversified stationery box for keeping and arranging a variety of drawings materials in order.

SUMMARY OF THE INVENTION

It is an object of the present invention to provide a stationery box which has diversified compartments for keeping a variety of drawing and writing materials in order and can be carried on one's shoulder by straps. It is another object of the present invention to provide a stationery box which is made in the shape of a V8 video camera and can be simultaneously used as an ornament.

According to the present invention, a stationery box is made in the shape of a V8 camera, having a hinged top cover which has partition strips for holding elongated writing or drawing materials, a hinged side cover which has a plate for holding paints, an inner box at the inside which has a drawer for keeping small writing material and a rotary crayon holder for keeping crayons, a pen holder at the inside which has slots and vertical grooves for inserting elongated writing or drawing materials, and a sliding seat moved to carry crayons away from said rotary crayon holder.

DETAILED DESCRIPTION OF THE PREFERRED EMBODIMENT

Figure 1:
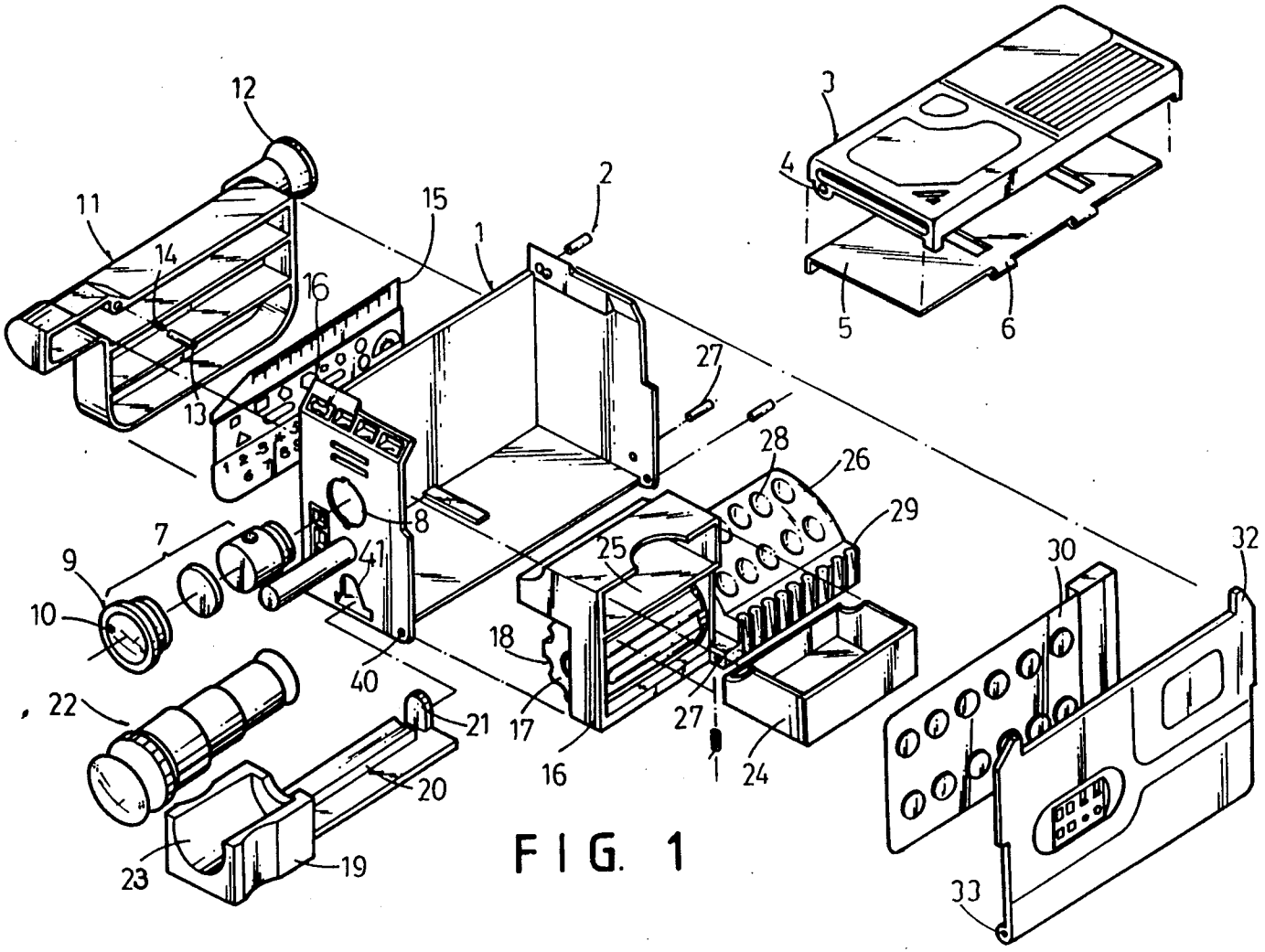
FIG. 1 is an exploded perspective view of a stationery box embodying the present invention.

Referring to FIG. 1, a stationery box as constructed in accordance with the present invention is generally comprised of a casing 1 made in the shape of a V8 video camera's housing; a top cover 3 which has two opposite holes 4 at one side pivotably secured to said casing 1 at the top by pivot pins 2; a flat board 5 hung on said top cover 3 at an opposite side by hinges 6; a cylindrical holder 7 made in the shape of a V8 video camera's lens and fastened in a hole 8 on said casing 1 at one side for holding a pencil sharpener, which cylindrical holder 7 has a lens 10 covered on the cap 9 thereof; a side case 11 movably secured to said casing 1 at one side buy a pin 13 and a spring 14, which side case 11 defines therein three separate compartments for keeping pencils and elongated writing materials and has a cylinder 12 at a suitable location in the shape of a viewfinder for a V8 video camera; a drawing scale 15 covered on said side case 11, which drawing scale 15 has a variety of holes for drawing circles, triangles and etc.; an inner case 16 fastened inside said casing 1; a sliding seat 19 movably inserted in a hole 41 on said casing 1 below the hole 8, which sliding seat 19 has a stop bar 21 vertically disposed at one end, a holding chamber 23 at an opposite end for keeping a telescope 22, and an elongated rail 20 at the middle; a rotary crayon holder 17 mounted on said elongated rail 20 and retained inside said inner case 16, which rotary crayon holder 17 has a plurality of elongated grooves 18 around the peripheral surface thereof for holding cylindrical crayons; a sliding box 24 inserted in a hole 25 on said inner case 16 for keeping erasers, pins and other small writing materials; a sloping pencil holder 26 pivotably fastened inside said casing 1 by a pin 27 and disposed at one side by said inner case 16, which pencil holder 26 has a plurality of slots 28 on the sloping top edge thereof for inserting crayons, painting brushes and etc., and a plurality of vertical grooves 29 on the peripheral surface thereon for holding thinner color pencils and the like; a side cover 32 which has two opposite holes 33 at one side pivotably secured to two opposite holes 40 on said casing 1 by pins; and a plate 30 releasably attach to said side cover 32 at the inside for keeping different paints. Further, a belt or strap may be attached to the casing 1 for carrying.

Figure 2:
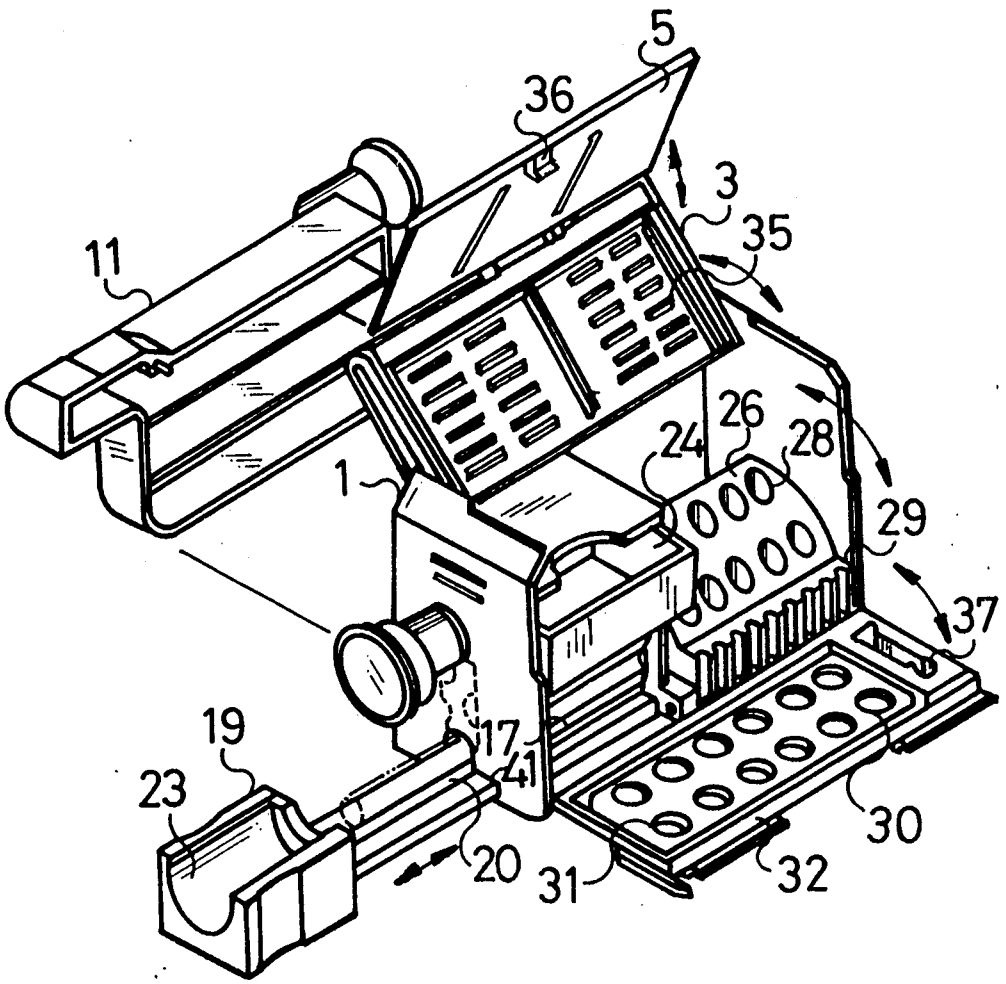
FIG. 2 illustrates the diversified stationery box in an extended status.

Referring to FIG. 2, the rectangular top cover 3 has a plurality of partition strips 35 longitudinally latitudinally aligned for keeping painting brushes. The flat board 5 has a hook 36 releasably hooked on the peripheral edge of the rectangular top cover 3 to keep painting brushes in the partition strips 35. Further, the plate 30 has a plurality of recessed holes 31 for keeping solid paints, and an elongated groove 37 for keeping liquid paint.

Figure 3:
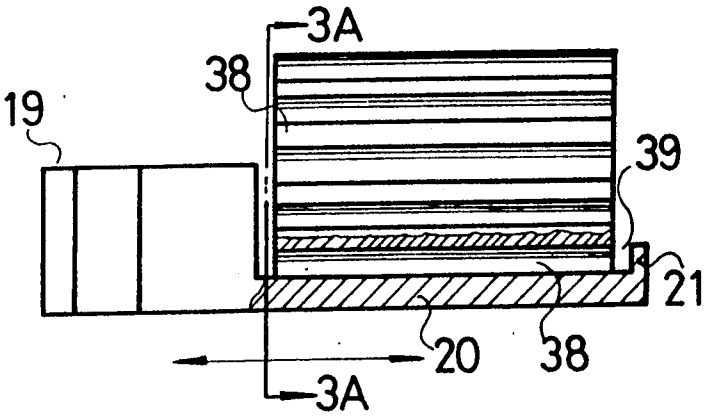
FIG. 3 is sectional views of the rotary crayon holder.
Figure 3A:
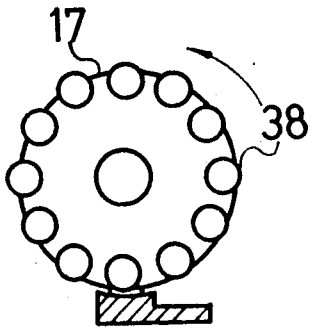
FIG. 3A is a cross-section taken on line 3A—3A of FIG. 3.
Figure 3B:
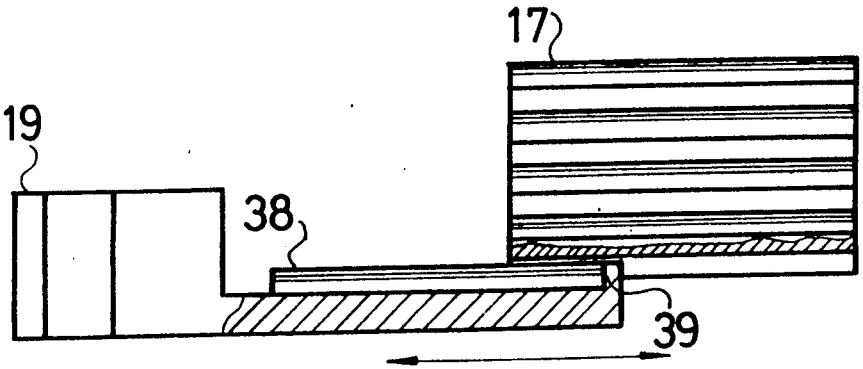
FIG. 3B illustrates that the sliding seat is drawn out of the casing to carry a crayon away from the rotary crayon holder.

Referring to FIG. 3, the rotary crayon holder 17 is made in the shape of the revolving cylinder of a revolver. By revolving the rotary crayon holder 17, the crayon 38 is a specific elongated groove 18 on the rotary crayon holder 17 is moved to the elongated rail 20 on the sliding seat 19 and stopped by the stop bar 21, and therefore, the crayon 38 can be carried out the casing 1 through the hole 41 when the sliding seat 19 is drawn out of the casing 1.

What is claimed is:

1. A stationery box made in the shape of a video camera, comprising a rectangular casing, a rectangular top cover pivoted to said casing at the top, a rectangular side cover pivoted to said casing at one side, a side box movably secured to said rectangular casing at an opposite side, an inner case fastened inside said casing at one side, a pen holder fastened inside said casing at an opposite side for holding pens and pencils, a sliding seat movably set in a hole on said casing, and a rotary crayon holder mounted on said sliding seat and retained in said inner case inside said casing, and characterized in that said rotary crayon holder comprises a cylindrical body having a plurality of elongated grooves longitudinally disposed around the peripheral surface thereof for holding crayons; said sliding seat has a stop bar at one end and moved, when said sliding seat is drawn out of said casing, to push a crayon away from said rotary crayon holder out of a hole on said casing.

2. The stationery box of claim 1, wherein said rectangular side cover has a plate attached thereto at an inner side, said plate having a plurality of recessed round holes and an elongated groove for holding paints.

3. The stationery box of claim 1, wherein said rectangular top cover has a plurality of partition strips longitudinally latitudinally aligned for holding elongated writing or drawing materials.

4. The stationery box of claim 1, wherein said pen holder has a plurality of slots on a sloping top edge and a plurality of vertical grooves on a vertical front wall respectively provided for holding elongated writing and drawing materials.

5. The stationery box of claim 1, wherein said side box has a plurality of compartments covered with a scale for keeping painting brushes and pencils.

6. The stationery box of claim 1, wherein said inner case has a hole for holding a drawer and a hole for holding said rotary crayon holder.

* * * * *